United States Patent [19]

Matumori

[11] Patent Number: 5,014,358

[45] Date of Patent: May 14, 1991

[54] SHOOTING COAT FOR ABSORBING SHOCK OF SHOOTING

[76] Inventor: Shigeru Matumori, Imaizumi 30-1, Toyama-shi, Toyama-ken 939, Japan

[21] Appl. No.: 375,245

[22] Filed: Jun. 30, 1989

[30] Foreign Application Priority Data

Jun. 30, 1988 [JP] Japan ..... 63-87149[U]

[51] Int. Cl.[5] ..... A41D 3/00

[52] U.S. Cl. ..... 2/94; 2/85; 2/93; 42/74

[58] Field of Search ..... 2/2, 2.5, 69, 84, 85, 2/92, 93, 94, 102; 42/74, 84

[56] References Cited

U.S. PATENT DOCUMENTS

| | | | |
|---|---|---|---|
| 574,728 | 1/1897 | Gerstenberger | 2/2.5 X |
| 2,063,469 | 12/1936 | Smith | 2/94 |
| 2,302,368 | 11/1942 | Evans | 2/94 |
| 2,466,567 | 4/1949 | Kropscott et al. | 2/2.5 X |
| 2,589,636 | 3/1952 | Smith | 2/2 |
| 2,744,846 | 5/1956 | Stickles | 2/2 |
| 2,771,384 | 11/1956 | Collins | 2/2.5 X |
| 2,948,899 | 8/1960 | Allen | 2/94 |
| 3,061,839 | 11/1962 | Foster | 2/2.5 |
| 3,105,241 | 10/1963 | Allen | 2/94 |
| 3,122,753 | 3/1964 | Smith | 2/94 |
| 3,257,666 | 6/1966 | Hoffman | 2/2 |
| 3,354,470 | 11/1967 | Allen | 2/94 |
| 3,403,407 | 10/1968 | Bishop et al. | 2/94 |
| 3,528,108 | 9/1970 | Smith | 2/94 |
| 3,567,568 | 3/1971 | Windecker | 2/2.5 X |
| 3,722,355 | 3/1973 | King | 2/2.5 X |
| 3,771,170 | 11/1973 | Leon | 2/2 |
| 4,242,769 | 1/1981 | Rayfield | 2/79 X |
| 4,602,385 | 7/1986 | Warren | 2/2 |
| 4,646,366 | 3/1987 | Nishida et al. | 2/108 |
| 4,810,559 | 3/1989 | Fortier et al. | 2/2 X |
| 4,905,320 | 3/1990 | Squyers, Jr. | 2/2.5 X |

FOREIGN PATENT DOCUMENTS

| | | | |
|---|---|---|---|
| 3132324 | 3/1983 | Fed. Rep. of Germany | 2/2 |
| 3530397 | 3/1987 | Fed. Rep. of Germany | 2/2 |
| 1450830 | 8/1966 | France | 2/94 |
| 2431674 | 3/1980 | France | 2/2.5 |
| 588829 | 6/1977 | Switzerland | 2/94 |
| 760093 | 10/1956 | United Kingdom | 2/93 |

*Primary Examiner*—Werner H. Schroeder
*Assistant Examiner*—Jeanette E. Chapman
*Attorney, Agent, or Firm*—Flynn, Thiel, Boutell & Tanis

[57] ABSTRACT

A shooting coat for absorbing shock of shooting comprises an outer cloth, a gun receiver pad attached to a rear surface of the outer cloth, a plurality of projections dispersed uniformly on an outer surface of the gun receiver pad, and a lining cloth attached over the projections for covering the gun receiver pad.

18 Claims, 4 Drawing Sheets

SHOOTING COAT FOR ABSORBING SHOCK OF SHOOTING

BACKGROUND OF THE INVENTION

1. Field of the invention

The present invention relates to a shooting coat for use in shooting and hunting, particularly for absorbing a shock of shooting by a gun.

2. Description of prior Art

In the case of shooting training and hunting, a shooting coat having a gun receiver pad stitched thereon at the portion where a gunstock touches the body is generally used. A shock generated by shooting is absorbed by the gun receiver pad for thereby preventing a shooter, a shooting trainee, or a hunter (hereinafter referred to as shooter) from being injured such as falling down, suffering a fracture, getting a bruise, etc.

In a prior art shooting coat, a hide, a synthetic hide, a thick cloth, a rubber sheet, etc are used as the gun receiver pad which are stitched on the shooting coat at the portion from a right shoulder to a breast. The gun has a gunstock plate at the end surface thereof for absorbing the shock of shooting and preventing the gunstock from being broken.

However, the gun receiver pad of the prior art shooting coat has a low elasticity so that there is a fear that the shooter may injure himself due to the shock caused by the shooting.

Furthermore, the hide, the synthetic hide, the thick cloth, etc. among the gun receiver pads serve to increase the thickness of the shooting coat for absorbing the shock. However, the gun receiver pad per se is weak in absorbing the shock of shooting to thereby endanger the shooter. The rubber sheet can absorb the shock by its elasticity but the repellent force of the rubber sheet after absorbing the shock is so large that the gun jumps forward by the repulsion against the shooting causing the gunbarrel to be jerked out of its original position. Since the gun thus jumped forward is difficult to return right away to its original position, it is hardly expected to succeed in a running hit.

Still furthermore, since the material of the prior art gun receiver pad has a low softness, when the gunstock is held by the shoulder, it is not well adapted to the shoulder or rather foreign to the shoulder. Hence, the gunstock must be pulled by hand forcibly against the shoulder to prevent the gun from slipping from the shoulder whereby the hitting rate is decreased because of exertion with might and main.

Inasmuch as the end plate of the base end of the gunstock per se is made of rubber or plastic, the shock absorbing characteristic thereof is not large and liable to cause an accident.

SUMMARY OF THE INVENTION

The present invention has been made in view of the problems of the prior art shooting coat.

It is therefore a first object of the present invention to provide a shooting coat for absorbing shock of shooting capable of preventing a shooter from falling down or being injured.

It is a second object of the present invention to provide a shooting coat for absorbing shock of shooting capable of increasing the hitting rate of shooting.

It is a third object of the present invention to provide a shooting coat for absorbing shock of shooting capable of being warm with comfort and without fatigue.

It is a fourth object of the present invention to provide a shooting coat for absorbing shock of shooting capable of almost absorbing the repulsion caused by the shooting without transmitting the repulsion to the shooter.

It is a fifth object of the present invention to provide a shooting coat for absorbing shock of shooting capable of relieving a shooter from the necessity of standing with might and main at the time of shooting.

To achieve the above objects, the shooting coat for absorbing shock of shooting comprises an outer cloth, a gun receiver pad attached to an inside surface of the outer cloth for receiving a shock of shooting by a gun, a plurality of projections dispersed uniformly on an outer surface of the gun receiver pad, and a lining cloth attached over the projections for covering the gun receiver pad.

The above and other objects, features and advantages of the present invention will become more apparent from the following description taken in conjunction with the accompanying drawings.

DESCRIPTION OF THE PREFERRED EMBODIMENTS

A shooting coat for absorbing shock of shooting of a gun according to a first embodiment will be described with reference to FIGS. 1 to 4.

A shooting coat W is illustrated as a trapshooting vest and comprises an outer cloth 1, a gun receiver pad Pa attached to an inside surface of the outer cloth 1, a plurality of projections 5 of hemispherical shape dispersed uniformly on an outer surface of the gun receiver pad Pa, and a lining cloth L (see FIGS. 1 and 11) attached over the projections 5 for covering the gun receiver pad Pa.

The projections 5 may be stitched on the outer cloth 1 by a thread at the inside surface thereof.

The gun receiver pad Pa and the projections 5 are integrally formed by an ultra-shock absorber made of foam plastics material. The gun receiver pad Pa may have an outer cover (not shown) such as a texture, a leather, or unwoven cloth respectively attached thereto.

If the shooter stands ready for shooting wearing the shooting coat W having such a structure while the gunstock is touched and received by the gun receiver pad Pa, the gunstock is softly fit against the gun receiver pad Pa and is prevented from slipping from the gun receiver pad Pa. The shock caused by shooting a bullet can be softly received by the shoulder without suffering from any pain so that even a woman will not fall on the ground.

Figure 1:
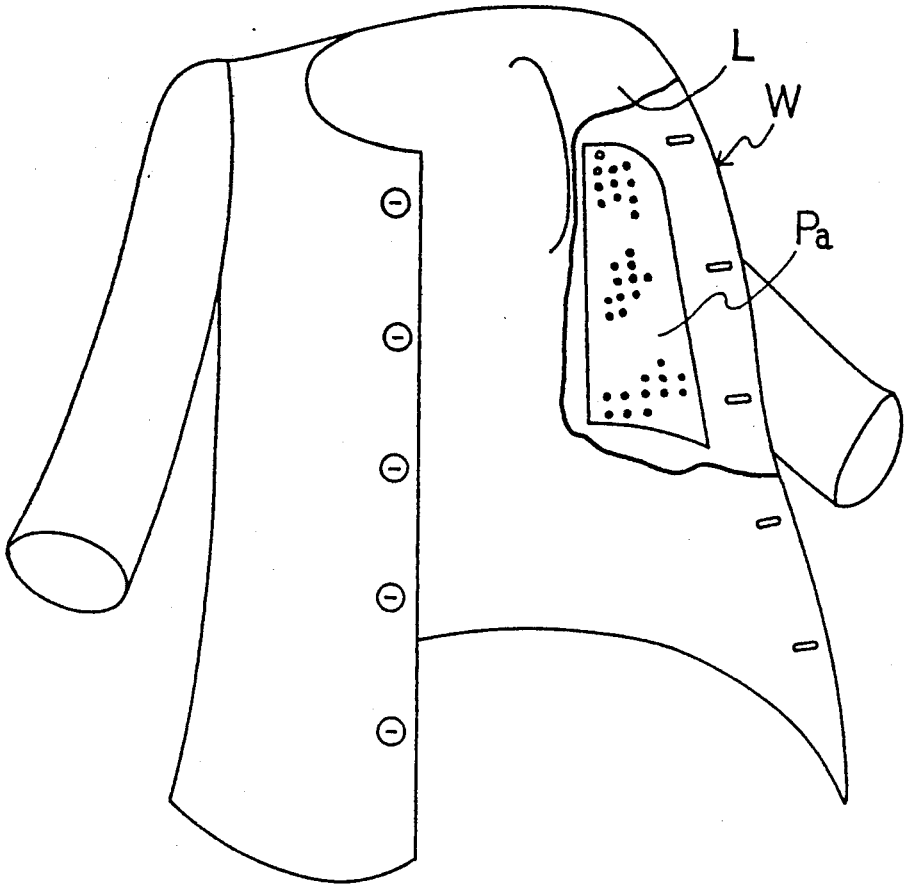
FIG. 1 is a perspective view showing a shooting coat for absorbing shock of shooting according to a first embodiment of the present invention.
Figure 2:
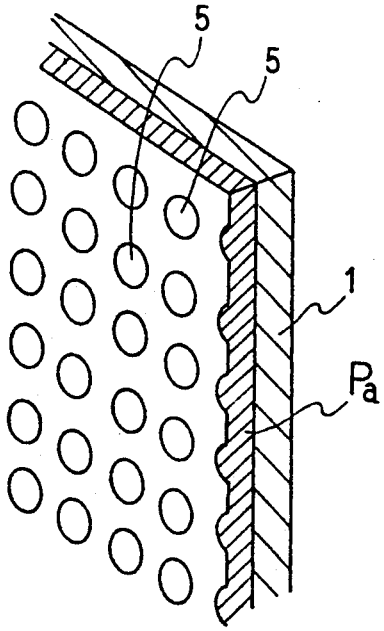
FIG. 2 is an enlarged perspective view of a main portion of the shooting coat of FIG. 1.
Figure 3:
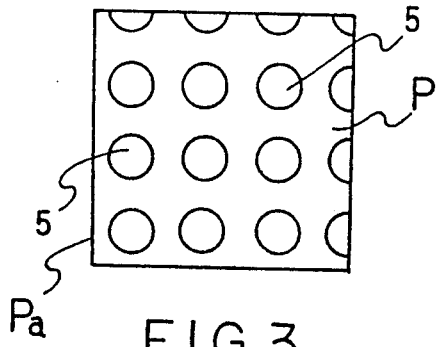
FIG. 3 is an enlarged plan view of a main portion of the shooting coat of FIG. 1.
Figure 4:
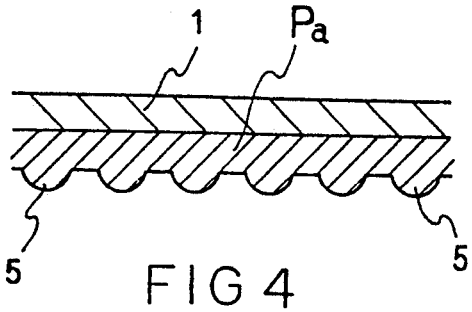
FIG. 4 is an enlarged cross sectional view of a main portion of the shooting coat of FIG. 1.
Figure 5:
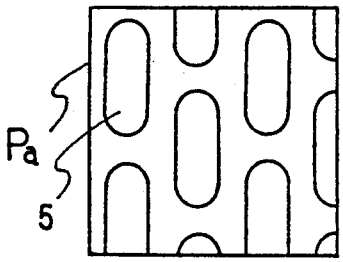
FIGS. 5 to 7 are respectively plan views of main portions of shooting coats for absorbing shock of shooting according to second embodiments of the present invention.
Figure 6:
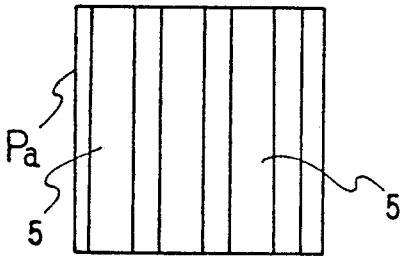
Figure 7:
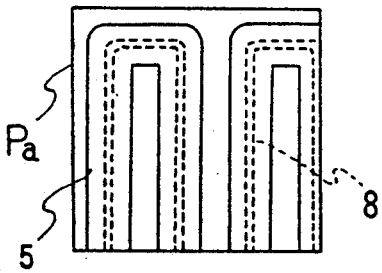

The plane shape of the projection 5 attached on the outer surface of the pad Pa is not limited to a circular shape but may be long elliptical shape as shown in FIG. 5, a heavy line shape (i.e. a rib shape) as shown in FIG. 6, or a meandering shape as shown in FIG. 7.

The cross sectional shape of the projection 5 may be wave shaped. The cross sectional shape of the projection 5 in FIGS. 6 and 7 is wave shaped and in such the case the gun receiver pad Pa having such wave shaped projection 5 can be reinforced by inserting a wire 8 in the projection 5 as shown in FIG. 7.

Figure 9:
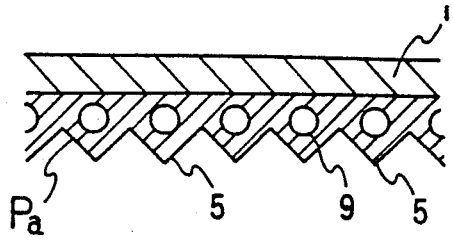
FIGS. 8 to 13 are respectively cross sectional views of main portions of shooting coats for absorbing shock of shooting according to third embodiments of the present invention.
Figure 10:
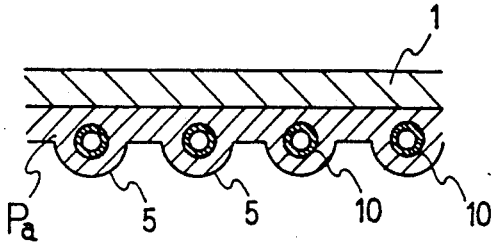
Figure 8:
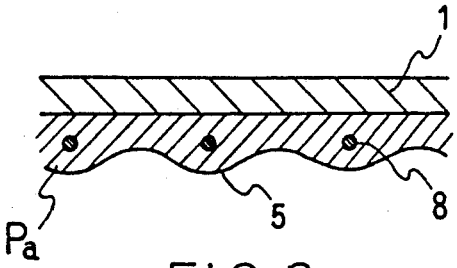

The cross sectional shape of the projection 5 in a third embodiment is wave shaped and the gun receiver pad Pa having such wave shaped projection 5 can be reinforced by inserting the wire 8 to the projection 5 as shown in FIG. 8 or can be more cushioned by providing a tunnel shape hollow 9 as shown in FIG. 9, or reinforced and more cushioned by inserting the small tube 10 in the projection 5 as shown in FIG. 10.

Figure 11:
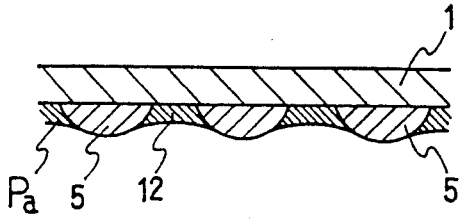

Another ultra-shock absorbing material having a small shock absorber coefficient may be inserted between a plurality of projections 5 to form a low surface layer 12 as illustrated in FIG. 11. With the arrangement, the shock is absorbed by double layers. The shock absorbing capacity can be increased by employment of material which is very soft and superior in shock absorbing.

Figure 12:
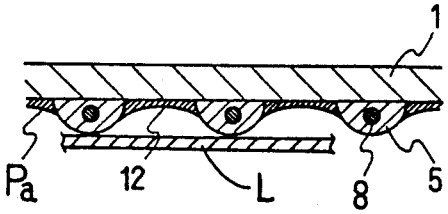
Figure 13:
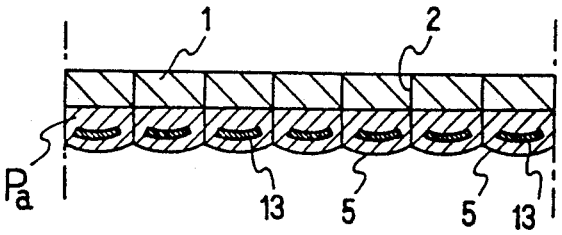
Figure 14:
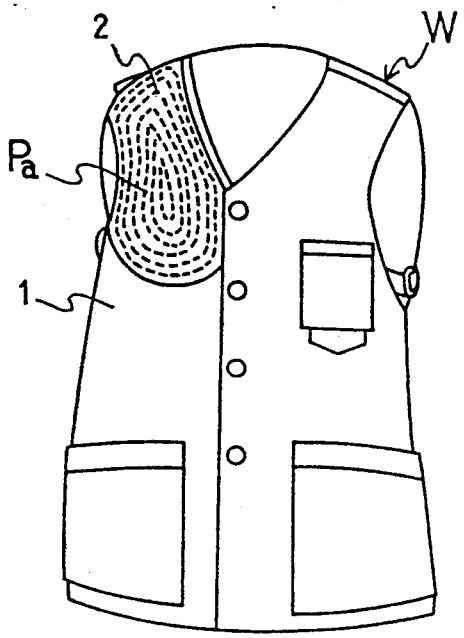
FIG. 14 is a front view showing a shooting coat for absorbing shock of shooting according to a fourth embodiment of the present invention.
Figure 16:
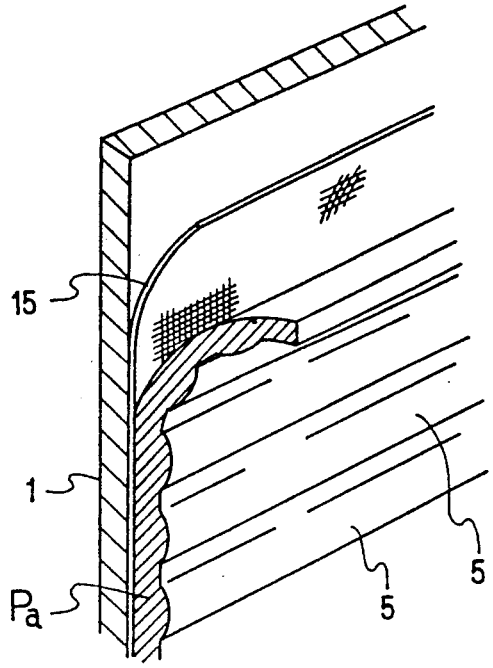
FIG. 16 is an enlarged perspective view of a main portion of the shooting coat of FIG. 14 in which parts of the main portion are peeled off.
Figure 15:
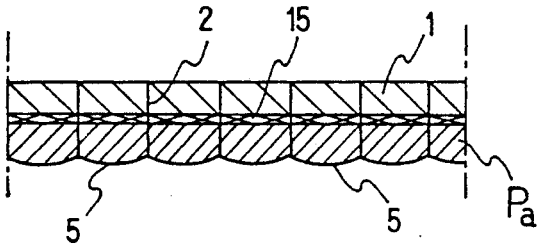
FIG. 15 is an enlarged cross sectional view of a main portion of the shooting coat of FIG. 14.

The projection 5 in heavy line shape also forms a low surface 12 as shown in FIG. 12. The projection 5 of the wave shape is formed on the pad Pa while a belt plate 13 made of an elastic material having a circular arc in cross section is inserted into the projection 5 for thereby preventing the vertical vibration of the gun receiver pad Pa to reinforce the pad Pa as shown in FIG. 13. In this embodiment, the gun receiver pad Pa is stitched on the outer cover 1.

Although the projections 5 in the second and third embodiments are formed on the inside surface of the outer cover 1, they project from the outer surface of the pad Pa.

A shooting coat according to a fourth embodiment of the present invention has a gun receiver pad Pa at the outside surface of the outer cover 1. A mesh 15 is inserted between the outer cover 1 and the gun receiver pad Pa for preventing vertical vibration and the gun receiver pad Pa is stitched on the outer cover 1.

Figure 17:
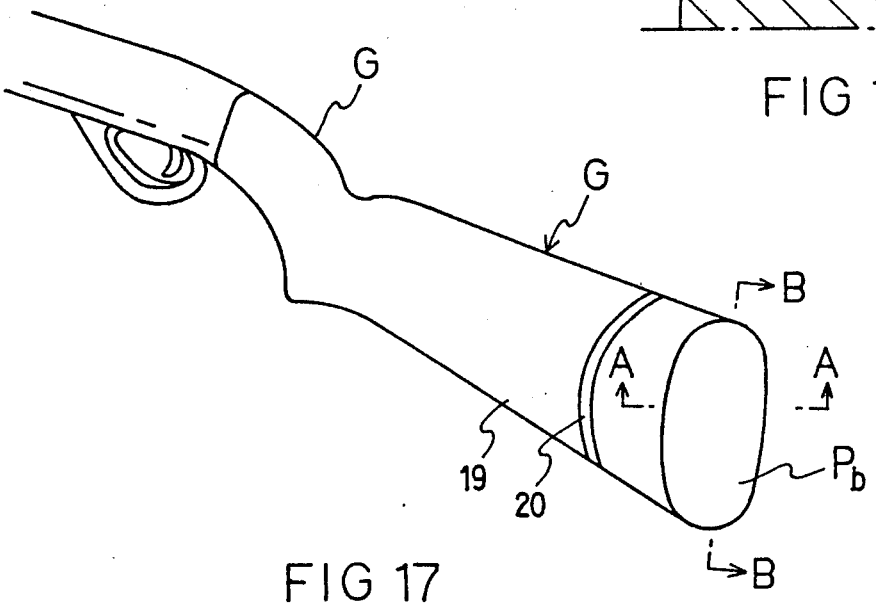
FIG. 17 is a partly cut away perspective view of a shooting gun.

The shooting coat according to the first to fourth embodiments is used for receiving a gun G as illustrated in FIG. 17.

The gun G has a pad Pb secured at the end surface of the gunstock 19 via a gunstock plate 20. The pad Pb can be directly attached to the gunstock 19 without providing the gunstock plate 20.

The pad Pb is made of a rubber or a synthetic rubber but may be made by an ultrasonic shock absorbing material.

Figure 18:
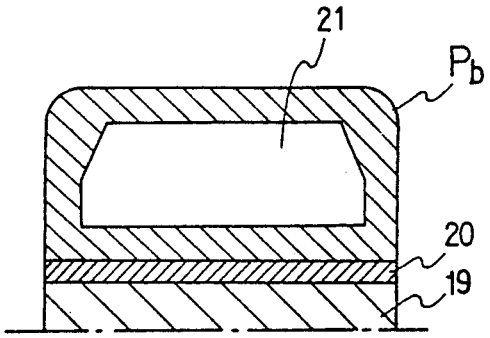
FIGS. 18 to 20 are respectively enlarged cross sectional views of other embodiments taken along the arrow A—A of FIG. 17.

The pad Pb has inside thereof a hollow portion 21 to thereby be formed as a hollow body as illustrated in FIG. 18. It is possible to insert ultra-shock absorbing material in the hollow portion 21 to increase the shock absorbing capacity.

Figure 19:
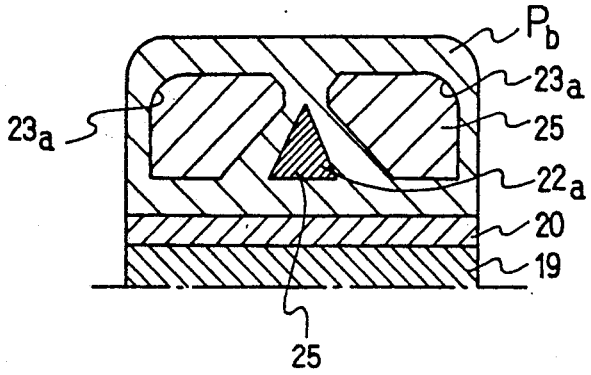

The pad Pb has inside thereof a central space portion **22*a* and side space portions 23*a*, 23*a* at the both sides of the central space portion 22*a* as illustrated in FIG. 19. The space portions 22*a*, 23*a* have inside thereof filling portions 25** in which the ultra-shock absorbing materials are filled.

Figure 20:
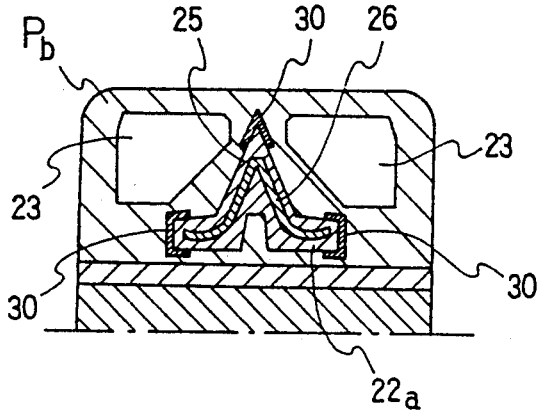

The pad Pb of an embodiment as illustrated in FIG. 20 has a central space portion **22*a* and side space portions 23, 23. The central space portion 22*a* has inside thereof a filling portion 25 in which the ultra-shock absorbing material can be inserted and a spring member 26** for suppressing the repulsion caused by the shooting of the gun G.

Figure 21:
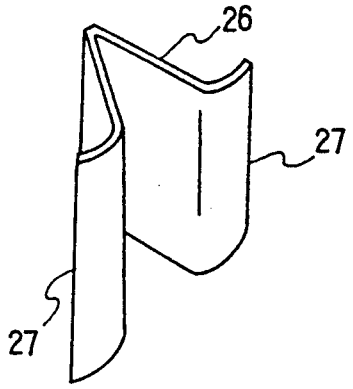
FIG. 21 is a perspective view of a spring employed in the shooting gun of FIG. 17.

As illustrated in FIG. 21, the spring member 26 is formed in V-shape so as to absorb the shock with ease and is provided with legs 27, 27 projecting outward at both lower ends thereof.

Figure 22:
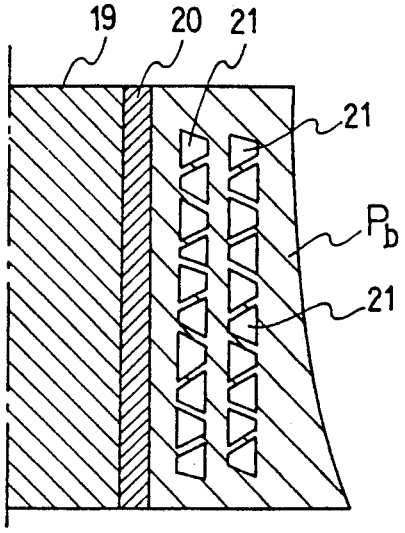
FIGS. 22 to 24 are respectively enlarged cross sectional view of other embodiments taken along the arrow B—B of FIG. 17.

As illustrated in FIG. 22, a plurality of oblong space portions 21 are arranged in two rows in the pad Pb. Each space portion 21 has a trapezoid shape to absorb the shock with ease.

Figure 23:
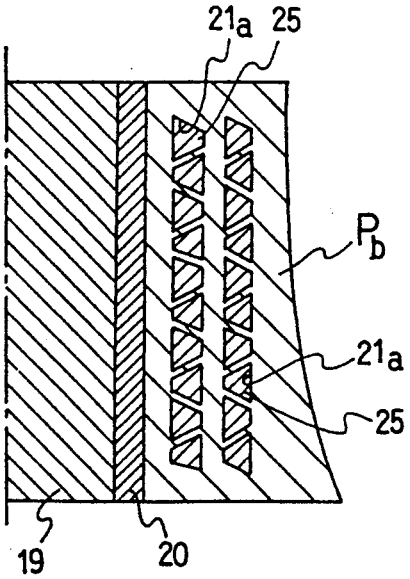

Each space portion **21*a* in the pad Pb has inside thereof a filling portion 25 in which the ultra-shock absorbing material can be filled as illustrated in FIG. 23**.

Figure 24:
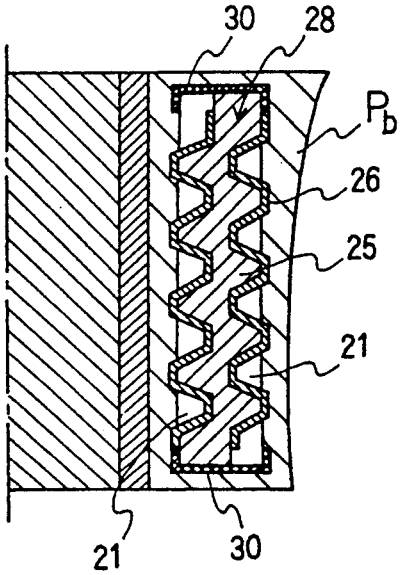

The pad Pb in FIG. 24 has inside thereof a wide space portion 28. A pair of spring members 26 are arranged in the wide space 28 while a filling portion 25 is inserted between the spring members 26. The spring members 26 are formed in stepped portions and each spring member 26 has at its outer side groove a space portion 21. Reinforced members 30 are attached to an upper end of one spring member 26 and to a lower end of the other spring member 26.

With the arrangement of the shooting coat for absorbing shock of shooting, the shock caused by the shooting is efficiently absorbed by the ultra-shock absorbing material. Inasmuch as the shock absorbing can be made in two stages in time sequence by the, projection and the pad, excessive collapse of the pad is prevented to mitigate the shock toward the body of the shooter. Furthermore, although in the prior art the gunbarrel hits the cheek of the shooter due to repulsion toward the cheek, namely, jumping of the gun to strike the cheek, the shooting coat according to the present invention can mitigate the shock toward the cheek.

Furthermore, the pad is brought into contact with the shoulder with uniform force and the shock of shooting can be absorbed, with ease by the hollow portion or the ultra-shock absorbing material in the pad. That is, the repulsion of shooting can be efficiently damped by the pad for mitigating the shock toward the cheek, the shoulder and the body of the shooter.

The ultra-shock absorbing material may have an absorbing characteristic superior than that of natural or synthetic rubber and may be of any kind such as an elastic material made in England called "SOLBOSAIN" or a material of a gel styrofoam called "DINACOIL". The gel material, α-gel having a thickness of 2 cm developed by Cubic Engineering Develop Co. does not permit breakage during the egg falling test. Furthermore, if a ball is dropped on the gel material, the ball scarcely bounces and stops as if it is absorbed by the gel material.

The shooting coat for absorbing shock of shooting has the following advantages.

(1) The shooting coat according to the present invention has a gun receiver pad at the portion from the shoulder to the breast which pad is made of an ultra-shock absorbing material and is provided with a plurality of projections on the outer surface thereof. Hence, the shooter wearing the shooting coat is effectively prevented from falling down or being injured because the shock caused by the shooting is softened by absorption in two steps when the bullet is shot diving shooting training or hunting. Furthermore, the gun receiver pad absorbs the shock of the shooting without repulsion so that the gunbarrel is not jerked out of position due to the repulsion caused by the shock and the shooter can take quick aim with precision, especially in the case of firing in rapid succession, to thereby increase the hitting rate of the bullet shot next. Still furthermore, the gun does not slip off from the gun receiver pad even if the gunstock touches slightly on the gun receiver pad so that it is not necessary to push the gun to the pad with might and main which thereby increases the hitting rate. The shooting coat can be worn by the shooter with comfort and without fatigue.

(2) The shooting coat according to the present invention has the gun receiver pad made of the shock absorbing material and defining inside thereof space portions and/or filling portions in which the ultra-shock absorbing material is inserted so that the repulsion caused by the shooting is almost absorbed by the pad without transmitting the repulsion to the shooter whereby the gun is used with safety and without injury. Repetition of shooting does not fatigue the shoulder so that women and children can operate the gun without accident. Furthermore, the pad is adapted to well fit to the shoulder so that the need for standing with might and main is naturally eliminated to permit standing with ease whereby the hitting rate of the bullet can be remarkably increased.

Although the invention has been described in its preferred form with a certain degree of particularity, it is to be understood that many variations and changes are possible in the invention without departing from the scope thereof.

What is claimed is:

1. A shooting coat for absorbing the shock of shooting, comprising:

an outer cloth;

a gun receiver pad attached to an inside surface of the outer cloth for receiving a shock of shooting by a gun;

a plurality of projections dispersed substantially uniformly on an outer surface of the gun receiver pad, each said projection having a wire thereinside, said projections together forming a wavelike shape; and a lining cloth attached over the projections for covering the gun receiver pad.

2. A shooting coat for absorbing shock of shooting according to claim 1, wherein the projection has a hemispherical shape.

3. A shooting coat for absorbing the shock of shooting according to claim 1, wherein the gun receiver pad and the projections are integrally formed by an ultra-shock absorber made of foam plastics material.

4. A shooting coat for absorbing the shock of shooting, comprising: p1 an outer cloth;

a gun receiver pad attached to an inside surface of the outer cloth for receiving a shock of shooting by a gun;

a plurality of projections dispersed substantially uniformly on an outer surface of the gun receiver pad, each said projection having inside thereof a small tube; and a lining cloth attached over the projections for covering the gun receiver pad.

5. A shooting coat according to claim 1, wherein the projections are elongate and extend in generally sidewardly spaced but parallel relationship relative to the outer surface of the gun receiver pad.

6. A shooting coat according to claim 5, wherein the projections are elongate so as to extend continuously from one edge of the pad to an opposite edge of the pad.

7. A shooting coat for absorbing the shock of shooting according to claim 4, wherein the gun receiver pad and the projections are integrally formed by an ultra-shock absorber made of foam plastics material.

8. A shooting coat according to claim 4, wherein the projections are elongate and extend in generally sidewardly spaced but parallel relationship relative to the outer surface of the gun receiver pad.

9. A shooting coat according to claim 8, wherein the projections are elongate so as to extend continuously from one edge of the pad to an opposite edge of the pad.

10. A shooting coat and a gun for absorbing shock of shooting, the shooting coat comprising an outer cloth, a gun receiver pad attached to an inside surface of the outer cloth for receiving shock of shooting by the gun, a plurality of projections dispersed substantially uniformly on an outer surface of the gun receiver pad, and a lining cloth attached over the projections for covering the gun receiver pad; and the gun to be received by the gun receiver pad has an end pad at the end surface of a gun stock via a gun stock plate.

11. A shooting coat and gun for absorbing shock of shooting according to claim 10, wherein the end pad is made of a rubberlike material.

12. A shooting coat and gun absorbing shock of shooting according to claim 10, wherein the end pad has inside thereof a hollow portion.

13. A shooting coat and gun for absorbing shock of shooting according to claim 10, wherein the end pad has inside thereof a central space and side space portions.

14. A shooting coat and gun for absorbing shock of shooting according to claim 13, wherein the central and the side space portions have inside thereof filling portion and spring member.

15. A shooting coat and gun for absorbing shock of shooting according to claim 14, wherein the spring member is formed in V-shape and provided with legs projecting outward at the both lower ends thereof.

16. A shooting coat and gun for absorbing shock of shooting according to claim 10, wherein the end pad has inside thereof a plurality of oblong space portions arranged in two rows, each being shaped in trapezoid.

17. A shooting coat and gun for absorbing shock of shooting according to claim 10; wherein the end pad has inside thereof a wide space in which a pair of spring members are arranged while a filling portion is inserted between the spring members.

18. A shooting coat and gun for absorbing shock of shooting according to claim 17, wherein the spring members are formed in stepped portions and each spring member has at its outer side groove a space portion while reinforced members are attached to an upper end of one spring member and to a lower end of the other spring member.

* * * * *